US007347268B2

(12) United States Patent
Layton

(10) Patent No.: US 7,347,268 B2
(45) Date of Patent: Mar. 25, 2008

(54) ONE TRIP FLOW TUBE EXERCISING TOOL

(75) Inventor: Benny C. Layton, Okmulgee, OK (US)

(73) Assignee: Baker Hughes Incorporated, Houston, TX (US)

( * ) Notice: Subject to any disclaimer, the term of this patent is extended or adjusted under 35 U.S.C. 154(b) by 534 days.

(21) Appl. No.: 11/131,726

(22) Filed: May 18, 2005

(65) Prior Publication Data

US 2006/0260796 A1 Nov. 23, 2006

(51) Int. Cl.
*E21B 43/12* (2006.01)

(52) U.S. Cl. ..... 166/332.1; 166/332.5

(58) Field of Classification Search ..... None
See application file for complete search history.

(56) References Cited

U.S. PATENT DOCUMENTS 4,273,194 A * 6/1981 Pringle et al. ..... 166/323
4,624,315 A * 11/1986 Dickson et al. ..... 166/323
4,796,705 A * 1/1989 Carmody et al. ..... 166/323
5,167,284 A * 12/1992 Leismer ..... 166/374
6,273,187 B1 8/2001 Voisin, Jr. et al. ..... 166/63

* cited by examiner

*Primary Examiner*—Frank Tsay
(74) *Attorney, Agent, or Firm*—Shawn Hunter

(57) ABSTRACT

A flow tube exercising tool and method for use are described for actuating the flow tube of a downhole safety valve in order to remove build ups of scale and debris from the safety valve and ensure proper operation. The exercising tool provides an engagement portion that underlies the lower end of the safety valve flow tube so that upward movement of the exercising tool will move the flow tube upwardly. Hydraulic fluid is then provided to the safety valve hydraulic controller to move the flow tube downwardly. Only a single trip of the flow tube exercising tool is necessary to accomplish multiple upward and downward movements of the flow tube.

20 Claims, 5 Drawing Sheets

ONE TRIP FLOW TUBE EXERCISING TOOL

BACKGROUND OF THE INVENTION

1. Field of the Invention

The invention relates generally to methods and devices for cleaning and remediating a subsurface safety valve or other downhole tool having a sliding sleeve member.

2. Description of the Related Art

Flapper-type valves are often used as safety valves within wells to selectively close off production. The usual flapper valve uses a torsion spring to bias the valve member toward a closed position. During normal operation, however, the flapper member is retained in an open position by an axially moveable flow tube. When the flow tube is moved upwardly within the production tubing, the flapper member is permitted to close under influence of the spring. To reopen the valve, the flow tube is moved downwardly within the production tubing to urge the valve back towards its open position.

One problem that has traditionally been faced by valves of this type is that scale, dirt, and other debris will often build up within the production tubing during typical production operations. This build up can render the safety valve partially or completely inoperable. The most deleterious build up will be that which occurs on and around the flow tube that is used to open the valve, making the flow tube difficult to physically move upwardly and downwardly. Additionally, the flapper mechanism may be encrusted with scale and other debris making it less likely to fully close when necessary. This means that the valve will be unable to function well in the event of an emergency requiring production flow to be closed off.

U.S. Pat. No. 6,273,187, entitled "Method and Apparatus for Downhole Safety Valve Remediation," describes a technique for removing scale and debris build up using explosive charges. The use of explosives, however, carries with it risks of damage to wellbore valve components as well as the potential for a breach of the production tubing string.

The harmful effects of scale and debris build up can be prevented and reduced by exercising the safety valve, through operation of its components, before the build up has reached a point where the safety valve is no longer fully operational. In the past, this has been accomplished using a gripping tool having mechanical slips that are set against the inside of the flow tube. Once the slips are set, the gripping tool can be pulled upwardly to move the flow tube upwardly or jarred downwardly to move the flow tube downwardly. Unfortunately, tools of this type tend to physically damage the flow tube and other wellbore components, due to the use of the slips.

The present invention addresses the problems of the prior art.

SUMMARY OF THE INVENTION

The invention provides an improved flow tube exercising tool and method of use. An exemplary flow tube exercising tool is described that is used in conjunction with the hydraulic controller of the safety valve to move the flow tube axially upwardly and downwardly in order to remove build ups of scale and debris from the safety valve and ensure proper operation. The exercising tool provides an engagement portion that underlies the lower end of the safety valve flow tube so that upward movement of the exercising tool will move the flow tube upwardly. Hydraulic fluid is provided to the hydraulic controller to move the flow tube downwardly. Only a single trip of the flow tube exercising tool is necessary to accomplish multiple upward and downward movements of the flow tube.

BRIEF DESCRIPTION OF THE DRAWINGS

For a thorough understanding of the present invention, reference is made to the following detailed description of the preferred embodiments, taken in conjunction with the accompanying drawings in which like reference characters designate like or similar elements throughout the several figures of the drawing.

DETAILED DESCRIPTION OF THE PREFERRED EMBODIMENTS

Figure 1:
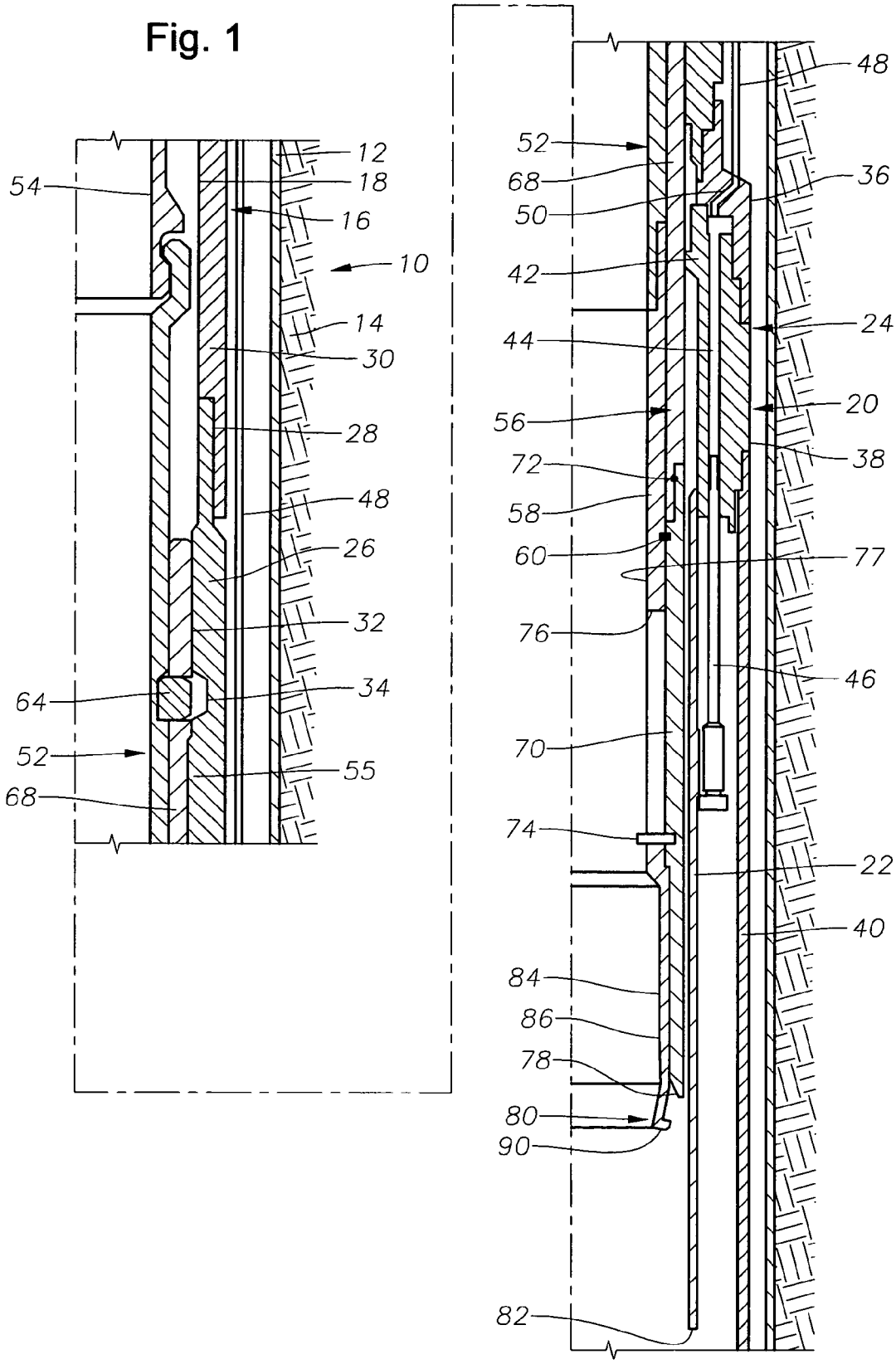
FIG. 1 is a side, cross sectional view of an exemplary flow tube exercising tool constructed in accordance with the present invention wherein the exercising tool is being run into production tubing.

FIGS. 1-4 illustrate a section of a subterranean wellbore 10 that has been lined with steel casing 12 that has been cemented in place by cement layer 14. The wellbore 10 contains a string of production tubing 16 that defines a production flowbore 18 along its length. A safety valve, generally indicated at 20 is integrated into the production tubing string 16. The safety valve 20 is a flapper valve, of a type that is well known in the art and described in, for example, U.S. Pat. No. 4,415,036 issued to Carmody. U.S. Pat. No. 4,415,036 is owned by the assignee of the present invention and is incorporated herein by reference. In the safety valve 20, a flapper valve member (not shown) is biased toward a closed position by a spring (not shown), in the manner well known in the art. The flapper member is opened and retained in an open position by an axially moveable flow tube 22 which, in turn, is actuated by a hydraulic piston-type controller 24. For clarity, only the flow tube 22 and hydraulic controller 24 portions of the safety valve 20 are depicted in FIGS. 1-4.

At its upper end, the safety valve 20 includes a nipple adapter 26 that is secured by threaded connection 28 to a production tubing string member 30. The structure of the nipple adapter 26 is best appreciated by further reference to FIGS. 5 and 6, which depict portions of it in greater detail. The nipple adapter 26 defines an interior axial flowbore 32 along its length, and an annular dog recess 34 is located within the flowbore 32. An upwardly directed stop shoulder 35 is also located within the flowbore 32.

At its lower end, the nipple adapter 26 is affixed to the hydraulic controller 24. The hydraulic controller 24 has an annular outer housing that is made up of an upper hydraulic control sub 36 and a lower hydraulic control sub 38. The lower sub 38 is secured at its lower end to a flapper valve housing 40 that encloses the flapper valve member (not shown). An inner housing portion 42 is secured to the lower sub 38 and a hydraulic fluid piston chamber 44 is defined within the upper and lower control subs 36, 38. An axially moveable piston member 46 is disposed within the chamber 44. At its lower end, the piston member 46 is secured to the flow tube 22 such that downward axial movement of the piston member 46 within the chamber 44 will result in axial downward movement of the flow tube 22. One or more hydraulic lines 48 extend from surface (not shown) of the wellbore 10 to the upper hydraulic control sub 36 and interconnect to a fluid passage 50 within the upper sub 36. The fluid passage 50 interconnects the hydraulic line 48 to the hydraulic fluid piston chamber 44.

Also shown in FIGS. 1-4 is a flow tube exercising tool 52 that is run into the flowbore 18 of the production tubing string 16 at the lower end of a wireline "GS" type running tool 54 of a type known in the art. The flow tube exercising tool 52 includes a tubular mandrel body 55 that is made up of an outer mandrel 56 and a radially inner mandrel 58. A shear pin 60 releasably interconnects the outer and inner mandrels 56, 58 against axial movement with respect to each other. The outer mandrel 56 includes an aperture 62 within which a locking dog 64 is disposed. The inner mandrel 58 has a dog recess 66 (see FIG. 5) which partially houses the dog 64 as well. The dog recess 66 is formed to have an angled cam face 67 at its upper end that faces downwardly and outwardly.

The outer mandrel 56 is composed of an upper section 68 and a lower section 70 that are releasably affixed to one another by a shear pin 72. The shear pin 72 is designed to rupture in response to a higher level of force than the shear pin 60. The lower section 70 also carries a shifting pin 74. The shifting pin 74 extends radially inwardly through a slot 76 in the inner mandrel 58 and extends further inwardly to project into the flowbore 77 that is defined within the inner mandrel 58.

The lower end of outer mandrel 56 is provided with an inwardly-directed tapered surface 78. The inner mandrel 58 has, at its lower end, a flow tube engagement portion 80 that is shaped and sized to underlie the lower end 82 of the flow tube 22. In a currently preferred embodiment, the engagement portion 80 is a colleted section 84 with each of the collets 86 presenting a radially outwardly protruding flange 90. The collets 86 are biased radially outwardly due to shape memory, and, in the initial run-in configuration depicted by FIG. 1, are restrained radially inwardly by the lower section 70 of the outer mandrel 56. The outer radial surface 92 of the outer mandrel 56 presents a downwardly facing stop shoulder 94 (see FIG. 5) that is shaped and sized to abut the stop shoulder 35 of the nipple adapter 26.

Figure 2:
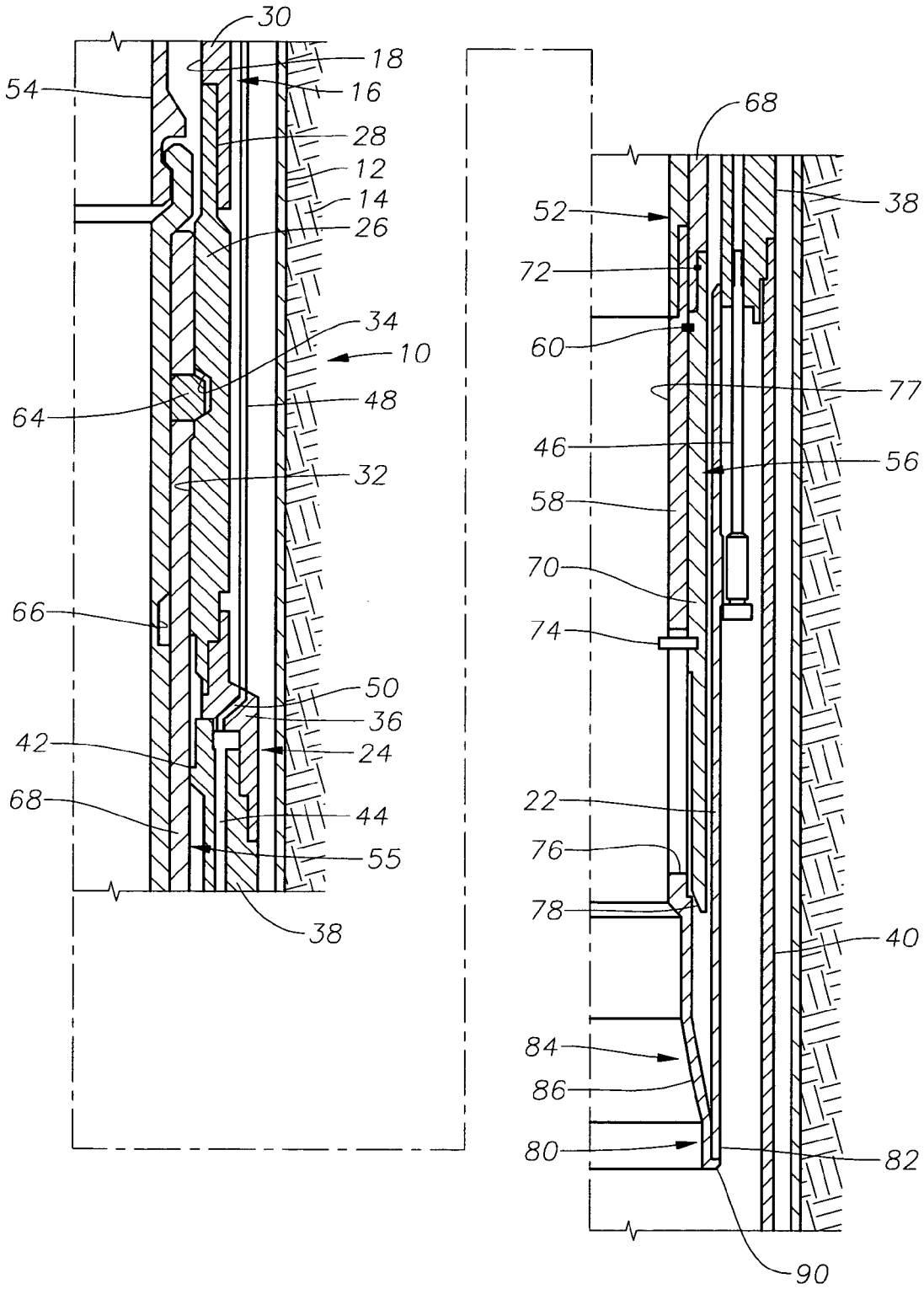
FIG. 2 is a side, cross-sectional view of the exercising tool shown in FIG. 1 now with the lower engagement portion of the exercising tool engaging the lower end of the safety valve flow tube.
Figure 3:
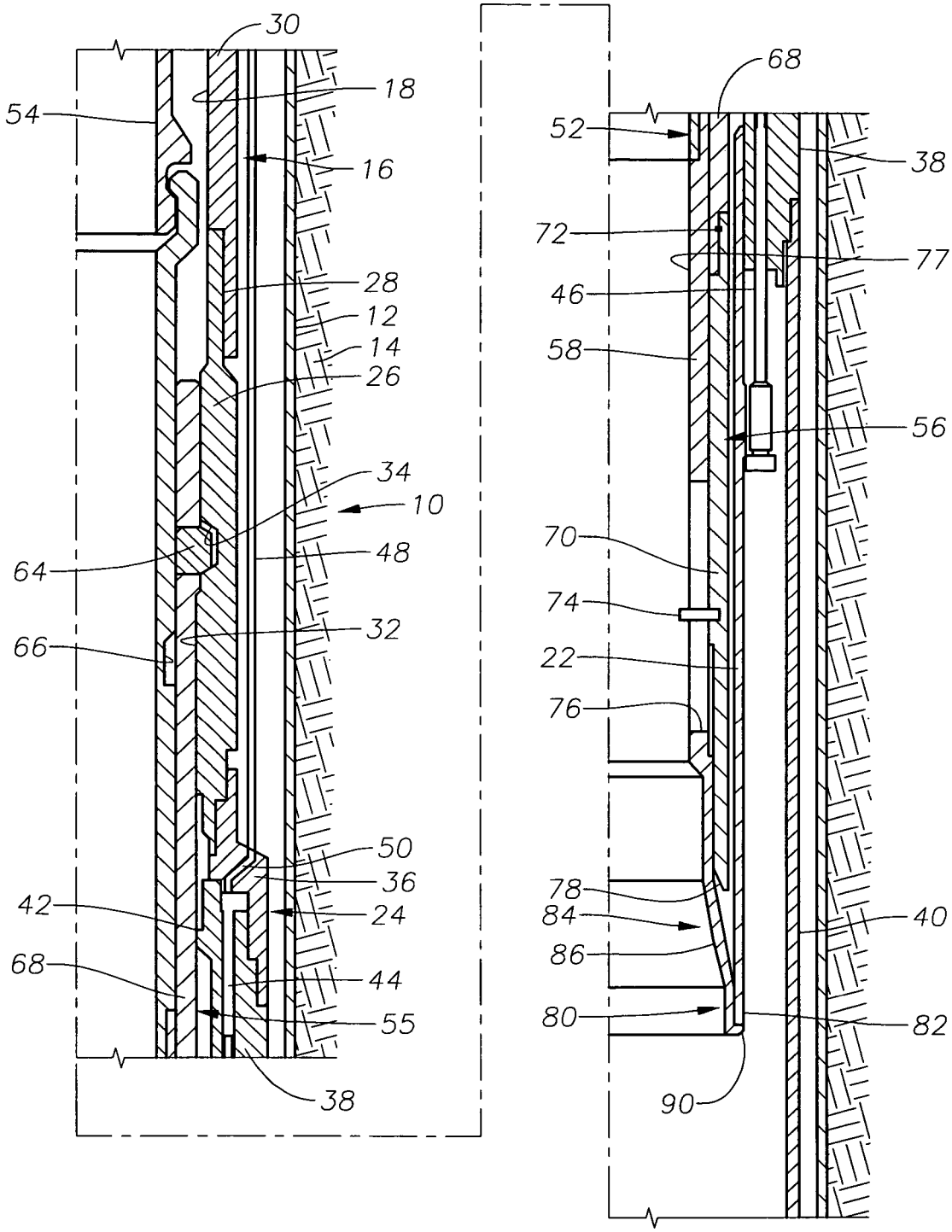
FIG. 3 is a side, cross-sectional view of the exercising tool shown in FIGS. 1 and 2 now with the flow tube having been raised to an upper position by the exercising tool.
Figure 4:
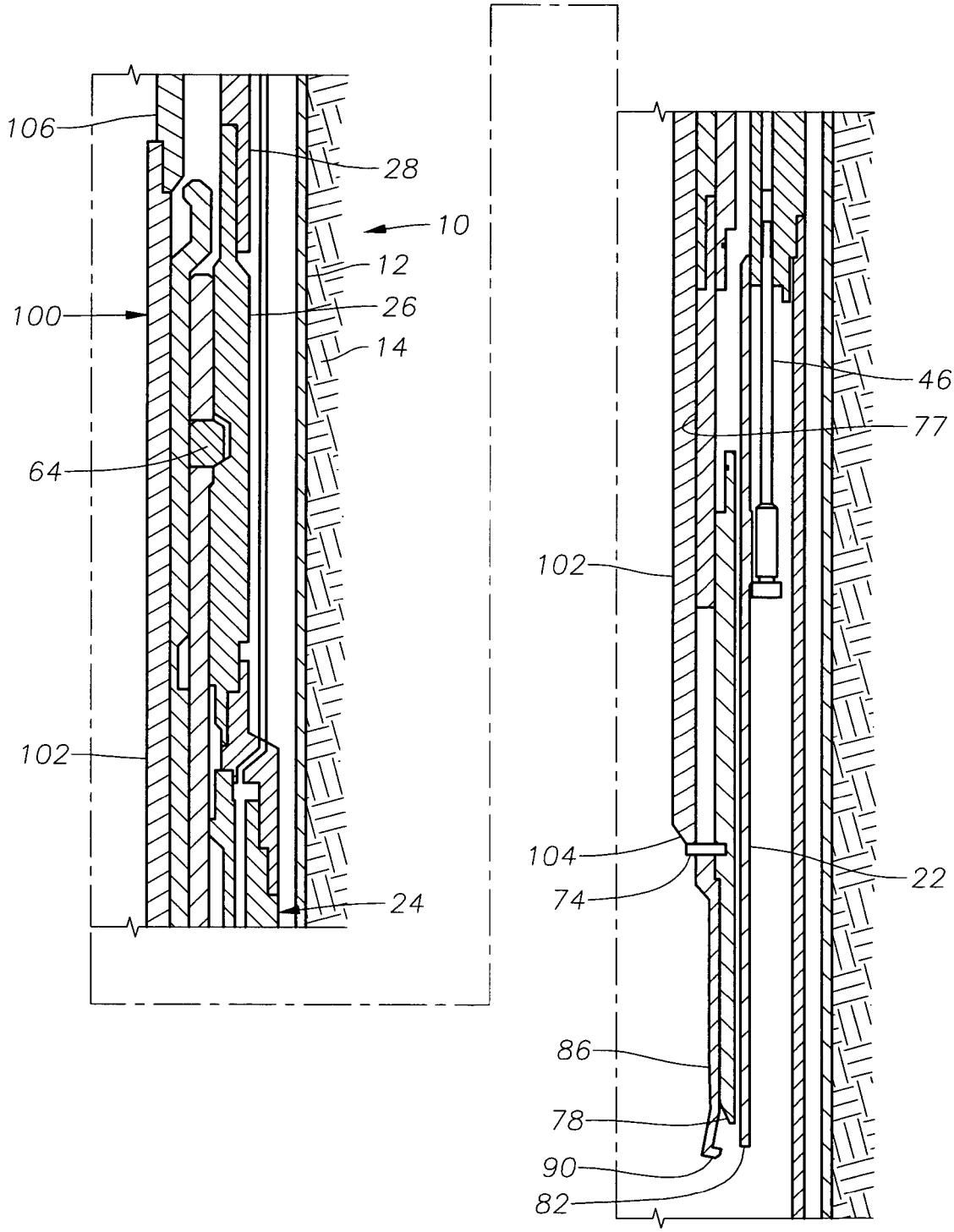
FIG. 4 is a side, cross-sectional view of the exercising tool shown in FIGS. 1-3 now with the tool being disengaged from the safety valve flow tube for removal from the production tubing.

In operation, the flow tube exercising tool 52 is run down into the flowbore 18 of the production string 16 and lowered until the stop shoulder 94 of the outer mandrel 56 abuts the stop shoulder 35 of the nipple adapter 26. This is the position shown in FIG. 1. Further downward movement of the running tool 54 will cause the shear pin 60 to rupture, thereby permitting the inner mandrel 58 to be moved axially downwardly with respect to the outer mandrel 56, until the position depicted in FIG. 2 is reached.

Figure 5:
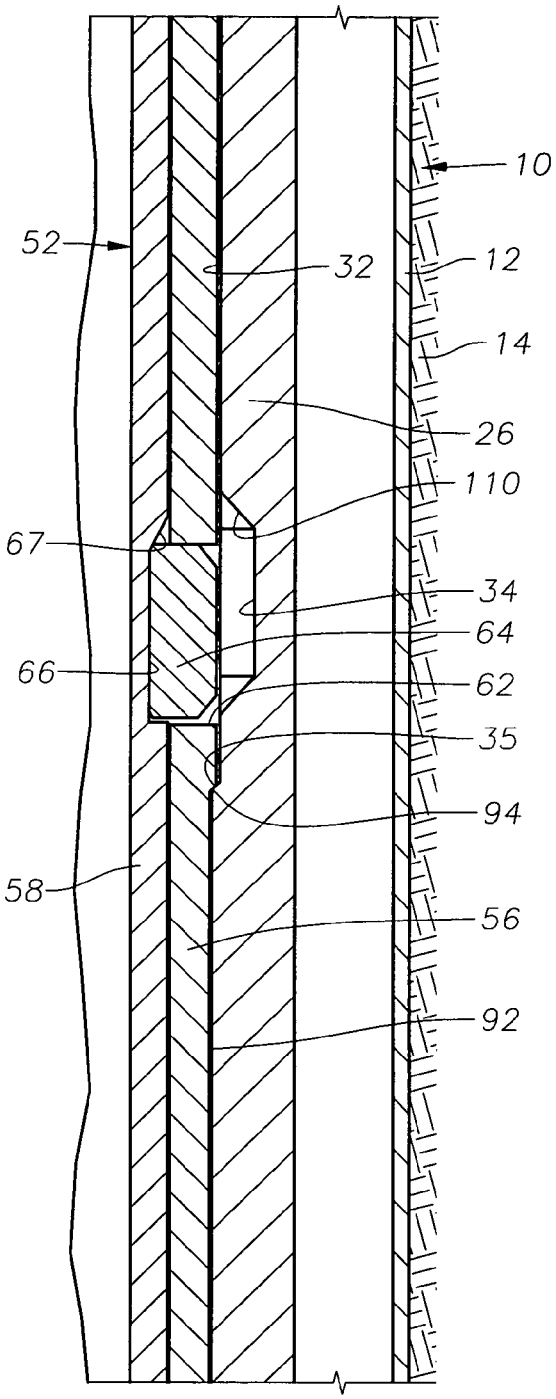
FIG. 5 is an enlarged view of upper portions of the exercising tool shown in FIGS. 1-4.
Figure 6:
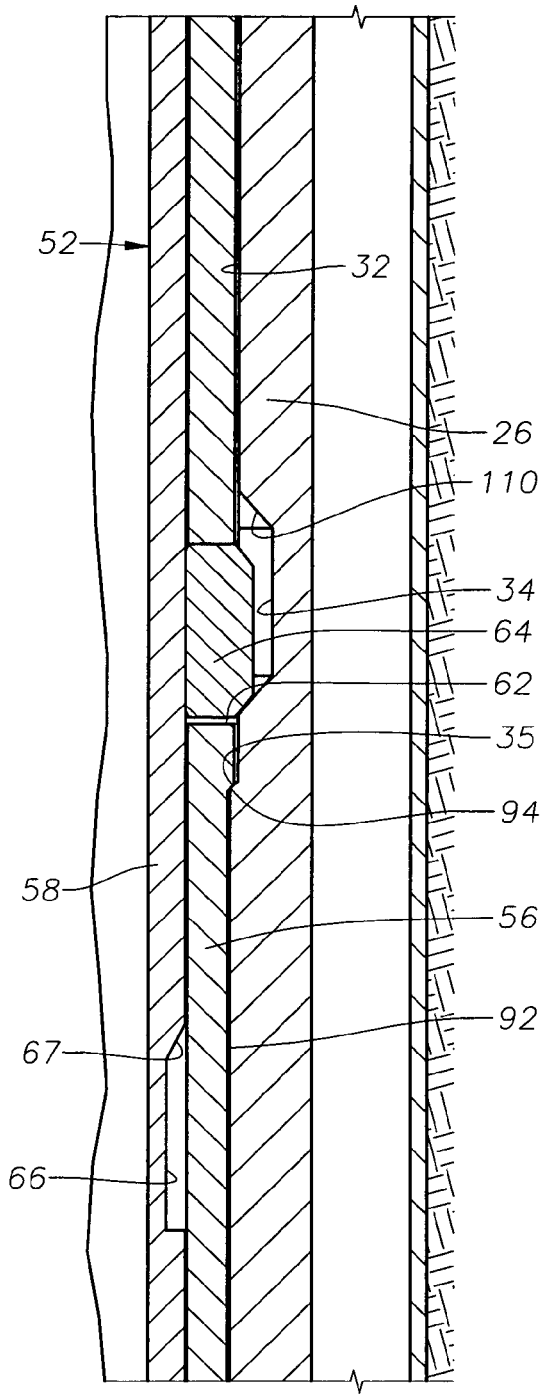
FIG. 6 is an enlarged view of upper portions of the exercising tool shown in FIGS. 1-4 now with the exercising tool engaged with the safety valve.

As the inner mandrel 58 is moved downwardly with respect to the outer mandrel 56, two things occur. First, the locking dog 64 is set into the dog recess 34 of the nipple adapter 26 in order to securely lock the outer mandrel 56 within the nipple adapter 26. FIGS. 5 and 6 illustrate the setting operation. As the inner mandrel 58 moves downwardly (from the position shown in FIG. 5 to the position shown in FIG. 6), the angled cam face 67 cams the locking dog 64 radially outwardly and into the dog recess 34 in the nipple adapter 26. The body of the inner mandrel 58 then blocks the locking dog 64 from moving radially inwardly, securing it in place within the dog recess 34.

Also, as the inner mandrel 58 reaches its lowermost position, the collets 86 are no longer restrained from outward movement by the lower section 70 of the outer mandrel 56 and will move outwardly so that the flange 90 will underlie the lower end 82 of the flow tube 22. Once in this position, the flow tube exercising tool 52 may be used, in conjunction with the hydraulic controller 24 to move the flow tube 22 axially upwardly and downwardly in order to remove scale and debris from the safety valve 20 and to ensure that the valve 20 is fully operational. By pulling upwardly on the running tool 54, the inner mandrel 58 of the exercising tool 52 is moved upwardly with respect to the outer mandrel 56. Due to the engagement of the flange 90 with the lower end 82 of the flow tube 22, the flow tube 22 is moved axially upwardly within the valve 20.

To return the flow tube 22 to its lowered position, hydraulic fluid is pumped down the hydraulic line 48 to the hydraulic controller 24 and into the hydraulic chamber 44 to cause the piston member 46 and flow tube 22 to move axially downwardly. The flow tube 22 may be manipulated upwardly and downwardly by repeating the above operational steps as many times as desired to ensure proper operation of the valve 20 and the removal of scale and other deposits from its components.

Normally, the exercising tool 52 may be detached from the flow tube 22 by merely pulling upwardly with sufficient force that the collets 86 are deflected radially inwardly and thus released from the lower end 82 of the flow tube 22. At that point, the exercising tool 52 is withdrawn from the safety valve 20 and from the tubing string 16. If, however, the exercising tool 52 cannot be detached in this manner, a release tool 100, shown in FIG. 4, can be run into the interior flowbore 77 of the exercising tool 52 and used to disengage the exercising tool 52 from the valve 20. The release tool 100 is a tubular sleeve 102 having an axial end portion 104 for contacting the shifting pin 74. The sleeve 102 is run into the flowbore 77 using a wireline running tool 106, of a type known in the art. In operation, the end portion 104 of the sleeve 102 contacts the shifting pin 74 and urges it axially downwardly. The shear pin 72 then ruptures, allowing the upper and lower sections 68, 70 of the outer mandrel 56 to separate. The lower portion 70 is moved downwardly so that the tapered surface 78 will urge the collets 86 radially inwardly and out of engagement with the lower end 82 of the flow tube 22. The body of the lower portion 70 essentially acts as a wedge to physically separate the collets 86 from the flow tube 22. Once disengaged by the release tool 100, the exercising tool 52 may be removed from the valve 20 by pulling upwardly on the running tool 54. In so doing, the locking dog 64 will be released from the dog recess 34 when the inner mandrel 58 is raised to the point where the recess 66 is adjacent the locking dog 64. When this occurs, the dog 64 is cammed radially inwardly toward the recess 66 by sloped surface 110 on the upper side of the dog recess 34.

The flow tube 22 may be moved axially upwardly and downwardly in an alternating manner as described above as necessary to remove scale and other debris and ensure proper operation of the safety valve 20. Movement of the flow tube 22 may be exercised in this manner using only a single trip of the exercising tool 52 into the production tubing 16. However, the exercising tool 52 may also be run into the production tubing 16 on several separate occasions during the life of the wellbore to ensure continued proper operation of the safety valve 20 throughout.

Those of skill in the art will recognize that numerous modifications and changes may be made to the exemplary designs and embodiments described herein and that the invention is limited only by the claims that follow and any equivalents thereof.

What is claimed is:

1. A safety valve flow tube exercising tool for providing axial movement of a flow tube within a flapper-type safety valve, the tool comprising:

a mandrel body shaped and sized to reside within the flow tube of a flapper-type safety valve; and an engagement portion on the mandrel body shaped and sized to underlie a lower end of the flow tube so that upward movement of the mandrel body will move the flow tube axially upwardly within the safety valve.

2. The safety valve flow tube exercising tool of claim 1 further comprising a locking member for securing the mandrel body to a portion of the safety valve.

3. The safety valve flow tube exercising tool of claim 1 wherein the engagement portion comprises a collet having an outwardly projecting flange to underlie the lower end of the flow tube.

4. The safety valve flow tube exercising tool of claim 1 wherein the mandrel body further comprises:

an inner mandrel carrying the engagement portion; and an outer mandrel radially surrounding the inner mandrel, the outer mandrel having a lower section that is axially moveable with respect to the inner mandrel to be driven between the engagement portion of the inner mandrel and the flow tube to disengage the engagement portion from the lower end of the flow tube.

5. The safety valve flow tube exercising tool of claim 4 wherein:

the inner mandrel defines a slot;

the outer mandrel is separable into upper and lower sections; and the lower section carries a shifting member that is disposed through the slot and into a flowbore defined within the inner member such that the shifting member can be engaged by a release tool to cause the lower section to disengage the engagement portion from the lower end of the flow tube.

6. The safety valve flow tube exercising tool of claim 4 wherein the inner and outer mandrel are releasably secured to one another by a shear member.

7. The safety valve flow tube exercising tool of claim 4 wherein the outer mandrel presents a stop shoulder that is shaped and sized to contact a complimentary stop shoulder within the safety valve.

8. A system for exercising a flapper-type safety valve having an actuating flow tube, the system comprising:

a running tool;

a safety valve flow tube exercising tool secured to the running tool, the exercising tool comprising a mandrel body having an engagement portion shaped and sized to underlie a lower end of the flow tube so that upward movement of the mandrel body will move the flow tube axially upwardly within the safety valve.

9. The system of claim 8 further comprising a locking member that selectively secures the mandrel body of the exercising tool to a portion of the safety valve.

10. The system of claim 8 further comprising a release tool that is run into the exercising tool to release the engagement portion of the exercising tool from the flow tube.

11. The system of claim 8 wherein the mandrel body comprises an inner mandrel and a radially outer mandrel that are releasably secured to one another.

12. The system of claim 8 wherein the engagement portion comprises a collet having an outwardly projecting flange to underline the lower end of the flow tube.

13. A method of exercising a safety valve within a wellbore comprising the steps of:

disposing an exercising tool into a safety valve having a flapper element and a flow tube for selectively opening the flapper element;

disposing an engagement portion of the exercising tool beneath a lower end of the flow tube;

raising the exercising tool within the wellbore to raise the flow tube within the safety valve to an upper position; and actuating an actuator within the safety valve to move the flow tube to a lower position.

14. The method of claim 13 further comprising the step of locking the exercising tool into the safety valve.

15. The method of claim 14 wherein the step of locking the exercising tool into the safety valve comprises setting a locking dog into a dog recess in the safety valve.

16. The method of claim 13 further comprising the step of releasing the exercising tool from the flow tube.

17. The method of claim 16 wherein the step of releasing the exercising tool from the flow tube comprises pulling upwardly on the exercising tool to cause the engagement portion to disengage from the flow tube.

18. The method of claim 16 wherein the exercising tool is released from the flow tube by a release tool.

19. The method of claim 18 wherein the releasing tool contacts a shifting member to urge the engagement portion out of engagement with the flow tube.

20. The method of claim 19 wherein the engagement portion is urged out of engagement with the flow tube by:

separating a lower portion of the outer mandrel from an upper portion of the outer mandrel; and sliding the lower portion between the engagement portion and the flow tube to cause disengagement of the engagement portion from the flow tube.

* * * * *